US007108766B1

(12) United States Patent
Eskelinen et al.

(10) Patent No.: US 7,108,766 B1
(45) Date of Patent: Sep. 19, 2006

(54) DOCTOR UNIT IN A PAPER MACHINE

(75) Inventors: Ilkka Eskelinen, Varkaus (FI); Ilkka Rata, Jyväskylä (FI); Harri Ruotsalainen, Varkaus (FI); Jukka Samppala, Jyväskylä (FI); Heikki Toivanen, Jyväskylä (FI); Juhani Vestola, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 628 days.

(21) Appl. No.: 10/070,409

(22) PCT Filed: Sep. 12, 2000

(86) PCT No.: PCT/FI00/00768

§ 371 (c)(1),
(2), (4) Date: Mar. 6, 2002

(87) PCT Pub. No.: WO01/20077

PCT Pub. Date: Mar. 22, 2001

(30) Foreign Application Priority Data

Sep. 14, 1999 (FI) ..... 990385 U

(51) Int. Cl.
*D21G 3/00* (2006.01)

(52) U.S. Cl. ..... 162/263; 162/111; 162/198; 162/281

(58) Field of Classification Search ..... 162/111, 162/281, 198, 263, 252; 15/256.51; 118/712, 118/123; 427/356, 8
See application file for complete search history.

(56) References Cited

U.S. PATENT DOCUMENTS

| | | | | |
|---|---|---|---|---|
| 5,081,951 | A | 1/1992 | Most et al. | |
| 5,189,492 | A | 2/1993 | Sollinger et al. | |
| 5,221,351 | A | 6/1993 | Esser et al. | |
| 6,830,659 | B1 * | 12/2004 | Sovijarvi | 162/263 |

FOREIGN PATENT DOCUMENTS

| | | |
|---|---|---|
| DE | 3825415 | 12/1990 |
| DE | 19743279 | 4/1999 |
| EP | 0426980 | 5/1990 |

* cited by examiner

*Primary Examiner*—Peter Chin
(74) *Attorney, Agent, or Firm*—Fildes & Outland, P.C.

(57) ABSTRACT

A doctor unit in a paper machine includes a blade carrier having a blade holder fitted to the blade carrier. A doctor blade is mountable in the blade holder to doctor a roll or similar moving surface. The blade holder and/or doctor blade include one or more sensors installed inside the construction or on its surface. The sensors are arranged to measure the wear of and/or stress in the blade holder and/or doctor blade.

12 Claims, 5 Drawing Sheets

DOCTOR UNIT IN A PAPER MACHINE

TECHNICAL FIELD

The present invention relates to a doctor unit in a paper machine, which doctor unit includes a blade carrier with a blade holder fitted to it, in which a doctor blade is arranged to doctor a roll or a similar moving surface.

BACKGROUND OF THE INVENTION

The rate of wear of the doctor blade in the various doctor units in a paper machine varies greatly. Depending on the doctor blade's position, its working life can vary from tens of hours to as much as tens of days. In terms of the operation of the paper machine and the doctor units, the degree of wear and general condition of the doctor blade would be valuable information. First of all, replacements could be predicted and, on the other hand, breakages could be noticed immediately. In the worst case, a worn-out or damaged doctor blade may be used, which will naturally lead to a poor doctoring result. At the same time, the doctor unit or even the surface being doctored can be damaged. If this results in the doctor dropping through, both the damage and the cost will be great. However, no effective method or device exists for determining the degree of wear of a doctor blade. Suggestions have been made for installing angle-sensors at the ends of the doctor unit. However, the change in the angle between the blade holder and the blade carrier does not indicate wear with sufficient accuracy. This is especially so, as the doctor blade usually wears least at the ends and generally most in the centre. In addition, the measurement of the angle will not show local faults or wear peaks in the doctor blade, which always lead to a poorer doctoring result. There is also no effective apparatus for monitoring the condition of the blade holder while the paper machine is running.

The wear of the blade and the doctoring result are particularly affected by the blade load and the blade angle being used at the time. Usually, the doctor blade is pressed against the surface being doctored by a load imposed on the blade holder by loading devices. In known doctor units, the loading devices are calibrated when the paper machine is stopped. The specific force, corresponding to the feed pressure of the loading devices, which is required to lift the doctor blade off the surface being doctored, is then generally measured. The results obtained can thus only be used to calculate the desired blade load approximately. The method can also be applied roughly to determine the blade load when running, but the method is complicated and inaccurate. The method also does not provide blade-load values over the width of the doctor unit, which would be important information for monitoring the doctoring result and the wear of the doctor blade.

SUMMARY OF THE INVENTION

The invention is intended to create a doctor unit in a paper machine, which can be used to monitor the wear and blade load of the doctor blade and the general condition of the other structures, also while the paper machine is running. The apparatus of the doctor unit can also be used during servicing or when making basic adjustments, when the paper machine is stopped. The settings of the doctor unit can then be made more easily and correctly than by previous methods.

A doctor unit in a paper machine includes a blade carrier having a blade holder, and a doctor blade fittable on the blade holder for doctoring a roll or similar moving surface, the doctor unit is characterized in that either the blade holder or doctor blade includes at least one sensor installed inside the construction or on its surface, and the sensor is arranged to measure either or both of the wear and stress in the blade holder or doctor blade.

In one embodiment at least one optical fiber is adapted as a sensor and installed inside the blade holder or doctor blade. The doctor unit may include light transmitting devices, at one end of the doctor unit, connected to the optical fibers, and light receiving devices at the other end. In another arrangement the blade holder may include a top plate, in which there are one or more optical fibers arranged in essentially the transverse direction of the doctor unit and extending from one end of the top plate to the other.

Preferably optical fibers installed inside the doctor blade and extending over the entire length of the doctor blade are arranged essentially transversely to the doctor unit 0.5–10 mm from each other. There may also be 1–15 optical fibers of the blade holder or the doctor blade. Each optical fiber includes filaments acting as sensory organs and the optical fiber is connected to an electrical crystal, which is arranged to send a signal when the resistance in the optical fiber changes.

In an alternative embodiment the surface of the blade holder or doctor blade includes at least one of a pressure-sensitive sensor and/or stress-strain sensor arranged to measure the blade load. Herein sensors are arranged essentially over the entire width of the doctor unit in the area of contact between the top plate belonging to the blade holder and the doctor blade.

The pressure-sensitive sensor may be one of a PVDF membrane sensor and an EMF sensor operating on the piezoelectric principle. 1–10 PVDF sensors may be fitted over the width of the doctor unit per meter of width of the doctor unit.

The duration of sensor measurement in connection with the blade holder or the doctor blade is configurable between momentary and continuous duration when the sensor is connected to a selected monitoring system.

At suitable locations in the doctor unit sensors are arranged, which are, as such, simple, but which, however, provide accurate information on the condition of the doctor unit even when running. The sensors do not affect the operation of the doctor unit and are easy to calibrate. The sensors and their locations are selected according to the variable to be measured. If desired, all the various sensors can be placed in a single doctor unit, in which case information on both the wear of the doctor blade and on the blade load will be obtained. At the same time, it is possible to monitor the general condition of the structures of the doctor unit. On the other hand, by selecting a certain type of sensor, it is possible to concentrate on monitoring a single important variable. Existing doctor units can also be easily utilized when creating a doctor unit according to the invention.

In the following, the invention is disclosed in detail by reference to the accompanying drawings showing some embodiments of the invention.

DETAILED DESCRIPTION OF THE INVENTION

Figure 1:
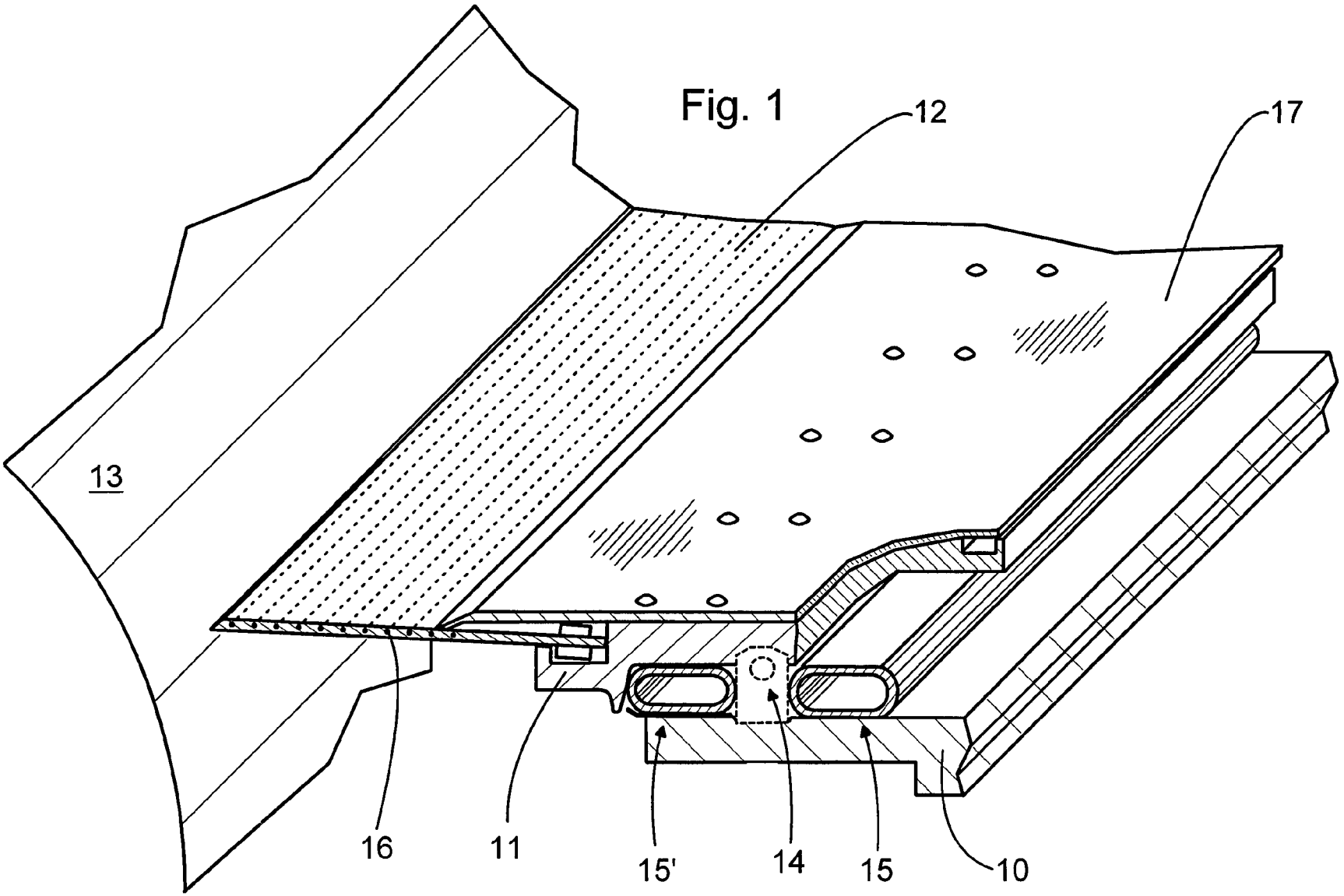
FIG. 1 shows an axonometric cross-section of one embodiment of a doctor unit according to the invention.

FIGS. 1–3 and 5 show a some different embodiments of a doctor unit according to the invention arranged in connection with a roll 13. The embodiments shown here as examples have a basic construction that is, as such, that of a conventional hose-loaded doctor unit. The invention can also be applied in fixed, i.e. stiff blade holders, in which the doctor blade is loaded by rotating the beam around its bearings. The sensors 18 can then only be used at the ends of the beam, to measure the angle of rotation or movement and the corresponding average wear of the blade. In this case, however, local wear values cannot be observed in the same way as they can in hose-loaded blade holders. A hose-loaded doctor unit includes a blade carrier 10 attached to the doctor-unit frame (not shown) and a blade holder 11 arranged in it. Fitted to the blade holder 11 is the actual doctor blade 12, by means of which the surface of roll 13 is doctored. The surface may also be some other moving surface, which it is wished to doctor. In a hose-loaded doctor unit, blade holder 11 is jointed rotatably to blade carrier 10. Here the doctor unit is shown in cross-section, so that joint 14 is shown by broken lines. In addition, there are loading hoses 15 and 15' between blade carrier 10 and blade holder 11, by means of which doctor blade 12 is rotated around joint 14. The operation of the loading hoses is, as such, known.

According to the present invention, the blade holder or the doctor blade or both include one or more sensors. Sensors are additionally installed inside or on the surface of the structure. The said sensors are arranged to measure the stress in the blade holder or the doctor blade or both. The wear in the doctor blade can also be measured. This provides continuous, precise, and comprehensive information on the doctor unit, by means of simple sensors, even when the paper machine is running. The following discloses some embodiments of a doctor unit according to the invention.

To measure the wear in, and condition of the doctor blade and blade holder, one or more optical fibres, arranged as sensors, are installed inside the blade holder or doctor blade or both. In principle, even a metal wire could be considered for this purpose. However, optical fibres 16 are preferably installed inside the doctor blade 12 of FIG. 1 and extend for the entire length of doctor blade 12. Devices inside the doctor unit are used to send light from one end of the optical fibres 16 to the other, where it is then detected. The apparatus arrangement relating to the optical fibres is disclosed in greater detail in connection with FIG. 4*a*. The said optical fibres are used to obtain precise information on the wear of the doctor blade, as a broken optical fibre will not conduct light. In other words, a doctor blade that has worn normally in the centre will have optical fibres remaining at the ends, even though they have worn through in the centre. In that case, the optical fibres that still conduct light will show the true maximum of the wear. The optical fibres are arranged essentially longitudinally in the doctor unit, 0,5–10 mm, preferably 2–6 mm from each other. The wear of the doctor blade can then be monitored very accurately, so that there should be no surprises in relation to wear.

Besides wear, optical fibres can also be used to provide information on the condition of the doctor blade. Non-conducting optical fibres between conducting fibres show a local fault, such as a fracture, in the doctor blade. At the location of the fault, the optical fibres are broken, which is thus immediately visible. Such a fault can be caused, for instance, by some sudden force acting on the doctor unit during the process. For example a lump of pulp, which has accumulated slowly, may suddenly break free and strike the doctor unit. In modern composite-construction doctor blades, a lump of pulp can cause an obvious break or a smaller hair crack. In either case, the entire doctor blade may break, or at least poor doctoring may result. The doctor blade should then be replaced, which is easily seen using a sensor solution according to the invention.

Figure 2:
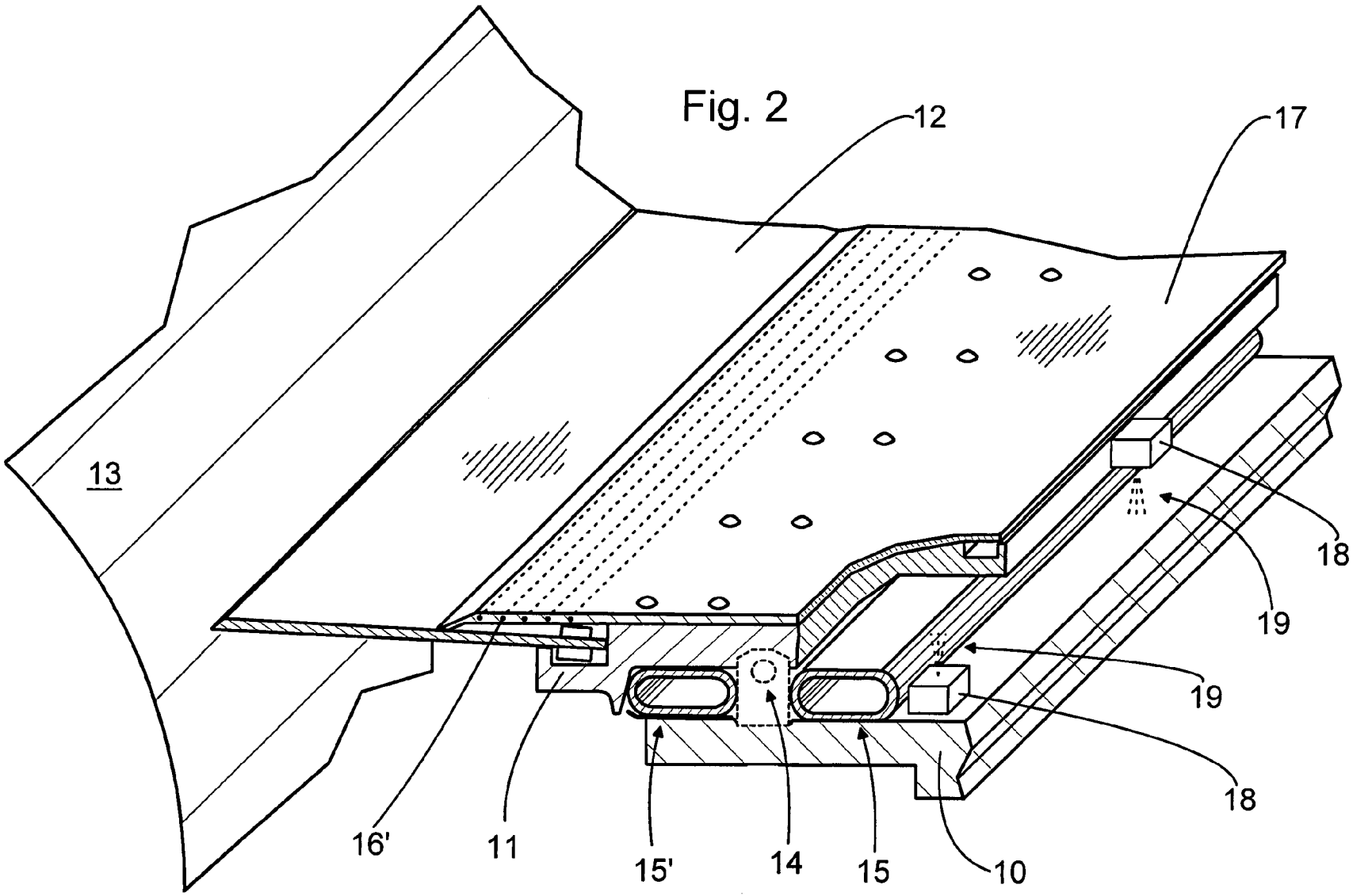
FIG. 2 shows a view similar to that of FIG. 1 of a second embodiment of a doctor unit according to the invention.

A lump of pulp can also damage the blade holder, which nowadays can also be manufactured from a composite material. It is practically essential to replace a damaged blade holder, as fractures will substantially weaken the holder. The next impact can then cause the entire blade holder to disintegrate, when the doctor blade will detach and drop out of place. To monitor the condition of the blade holder, one or more optical fibres 16' are arranged in the top plate 17, in essentially the longitudinal direction of the doctor unit and extending from one end of the top plate to the other. Such an embodiment is shown in FIG. 2. This embodies the same principle as that used in connection with the doctor blade. However, optical fibres 16' are not used to monitor the wear but the condition of top plate 17. Thus, in this case, an optical fibre that fails to conduct light shows a fault somewhere. The use of several optical fibres eliminates the possibility of an operating fault in an individual optical fibre. The top plate may also be referred to as a front plate or a back plate. The methods of measurement disclosed above and the sensors used can be applied to all types of blade holder.

In both of the embodiments disclosed above, the optical fibres can be entirely conventional. Alternatively, more highly developed optical fibres can be used, and will provide more precise information on the condition of the structures. For example, the use of lattice-structure optical fibres will allow the location of the damage to be determined more precisely. On the other hand, mirroring can provide distance data from even ordinary optical fibres, though the shortness of the optical fibre may then make measurement difficult.

Nowadays, composite structures are used in the manufacture of both doctor blades and top plates. In such cases, it is preferable to install the optical fibres inside the structure already during manufacture. Pultrusion is one manufacturing method permitting this. However, it is certainly also possible to install optical fibres later on the surface of metal blades or inside a sandwich construction. The number of optical fibres varies in different applications. Generally, there are 1–15, preferably 3–10 optical fibres in a blade holder or doctor blade. It is preferable to have more optical fibres in a doctor blade than in a top plate, as it is longer and the optical fibres wear along with the blade. In a blade holder, a few optical fibres according to FIG. 2 are sufficient.

Figure 4A:
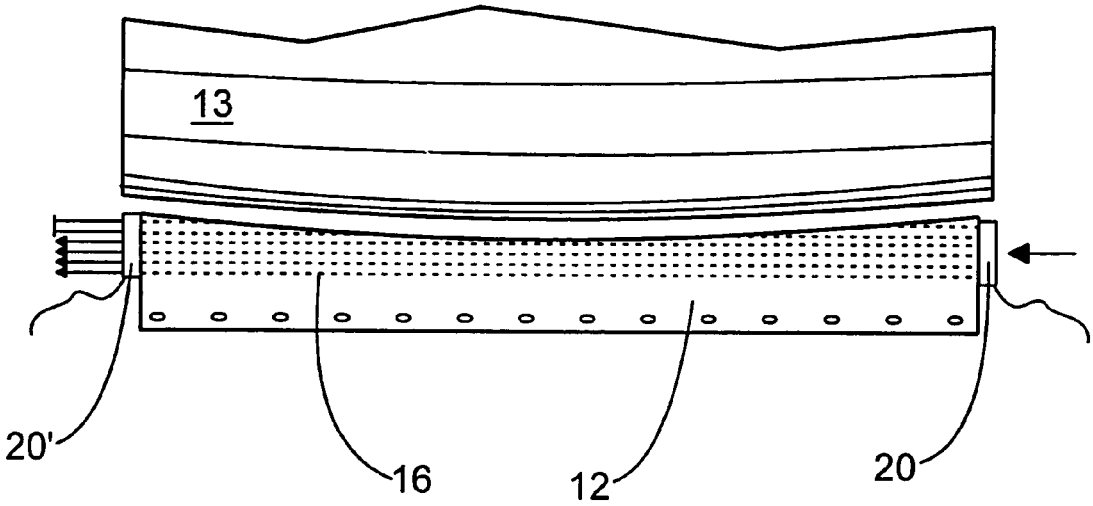
FIG. 4*a* shows a view from above of a diagram of an embodiment according to the doctor unit of FIG. 1.
Figure 4B:
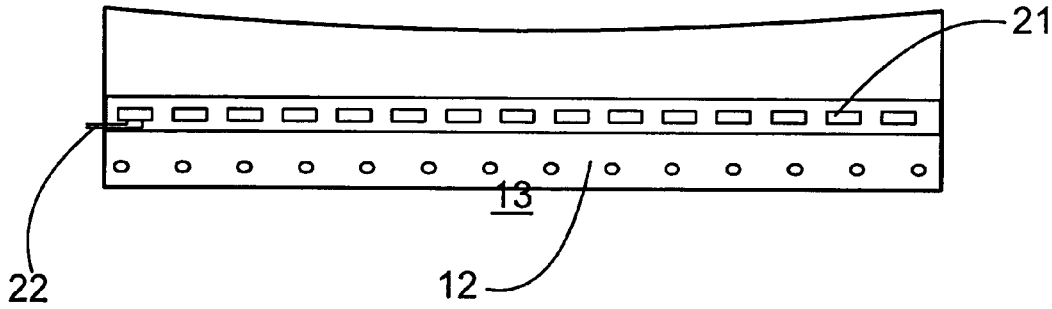
FIG. 4*b* shows a view from above of the detached doctor blade of a doctor unit according to FIG. 3.
Figure 4C:
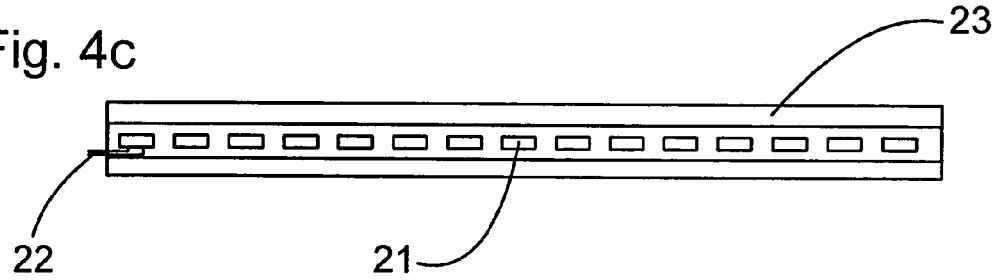
FIG. 4*c* shows a view from above of the additional part of an adaptation of the embodiment of FIG. 3.
Figure 4D:
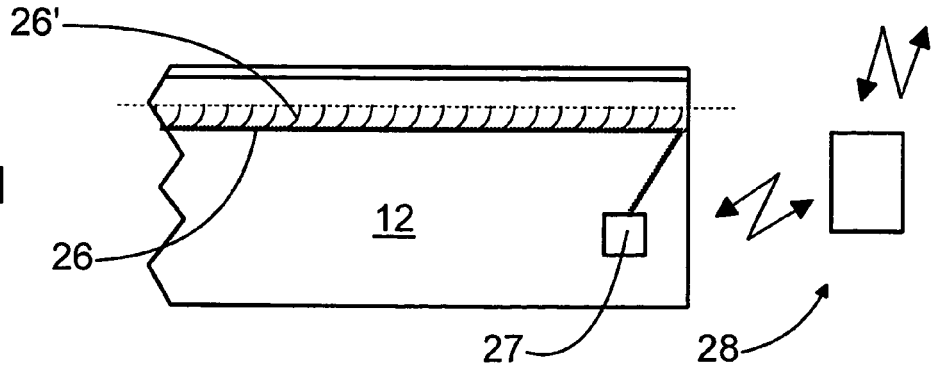
FIG. 4*d* shows a view from above of part of the doctor blade used in a doctor unit according to the invention.

FIG. 4*d* shows one embodiment of the use of more highly developed optical fibres. Here, optical fibre 26 is connected to an electrically charged crystal 27. Optical fibre 26 also incorporates filaments 26', which act as sensory organs. An optical fibre 26 is set at a distance of about 18–20 mm from the wearing edge composite blade 12, which is preferably manufactured by pultrusion. As is known, the doctor blade wears in use. When the wear reaches the filaments 26', the response given by the optical fibre 26 changes. Crystal 27 then sends a signal. A corresponding response takes place when a surface laminate possibly detaches or the doctor blade is otherwise damaged. The alarm limit is shown in FIG. 4*d* with a broken line.

The signal sent by crystal 27 is transmitted, for example, to a computer program preferably by means of wireless data transfer devices 28, such as a GSM modem. The electrical crystal can operate either actively the whole time or it can be activated by using the data transfer devices to allow the condition of the doctor blade to be checked.

In addition to the construction shown in FIG. 1, the wear of the doctor blade can be monitored by using another kind of sensor[s] installed in the doctor unit. In the embodiment in FIG. 2, inductive sensors 18 are installed in both the blade holder 11 and the blade carrier 10. Other kinds of sensors, which measure distance, movement, or angle of rotation, can also be used. The sensors 18 are calibrated for a certain distance. The brushes 19 shown by broken lines depict the direction of observation of the sensors 18, for example, when the sensors are in the rear of the blade holder. As doctor blade 12 continues to wear, the distance between blade holder 11 and blade carrier 10 continually increases. When the distance exceeds a set limit, the sensor emits a signal. Thus, sensors 18 act as a kind of limit switch, which report that the doctor blade will soon be worn out. This facilitates the planning of maintenance shutdowns and prevents the damage caused by the sudden wearing out of the doctor blade. To measure local differences and avoid erroneous messages, several sensors are installed in the doctor unit. As the doctor blade typically wears mostly in the middle, it is preferable to install the sensors in the center of the doctor unit. The sensors may also be on the front side of the blade holder, though the installation of the sensors is easier in the manner shown in FIG. 2. The measurement method disclosed above is applied mainly only in hose-loaded jointed blade holders.

In several cases, large variations have been observed in the rate of wear of the doctor blade, which can also be sudden. Such changes are usually due to changes that have taken place in the running parameters or chemical state of the process. The sensors are preferably connected to a system, which allows the monitoring of which the signals they give, and thus the rate of wear of the doctor blade. This makes is possible to recognise a situation in which, for example, the doctor blade is wearing rapidly. Thus, in the first place, it is possible to predict blade changes. In the second place, the continuous monitoring can be used to determine factors responsible for rapid wear. Thus, continuous monitoring of wear allows the process to be optimized to control the rate of wear of the doctor blade. The rate of wear affects not only the service life of the doctor blade, but also the doctoring result. It then becomes apparent how much fibre or fines pass under the doctor blade and, on the other hand, how clean the roll surface remains and how much material from the doctor adheres to the roll surface. A rate of wear that is too low will be insufficient to keep the point of the blade sharp. On the other hand, too great a rate of wear not only shortens the doctor blade's service life, but also gives a poor doctoring result. Therefore it is important to keep the rate of wear within an advantageous range. Besides sensors 18, rows of optical fibres or metal wires can also be used in the doctor blade to monitor the rate of wear. However, the rows must then be sufficiently close to each other, so that the rate of wear can be measured with satisfactory accuracy.

Figure 3:
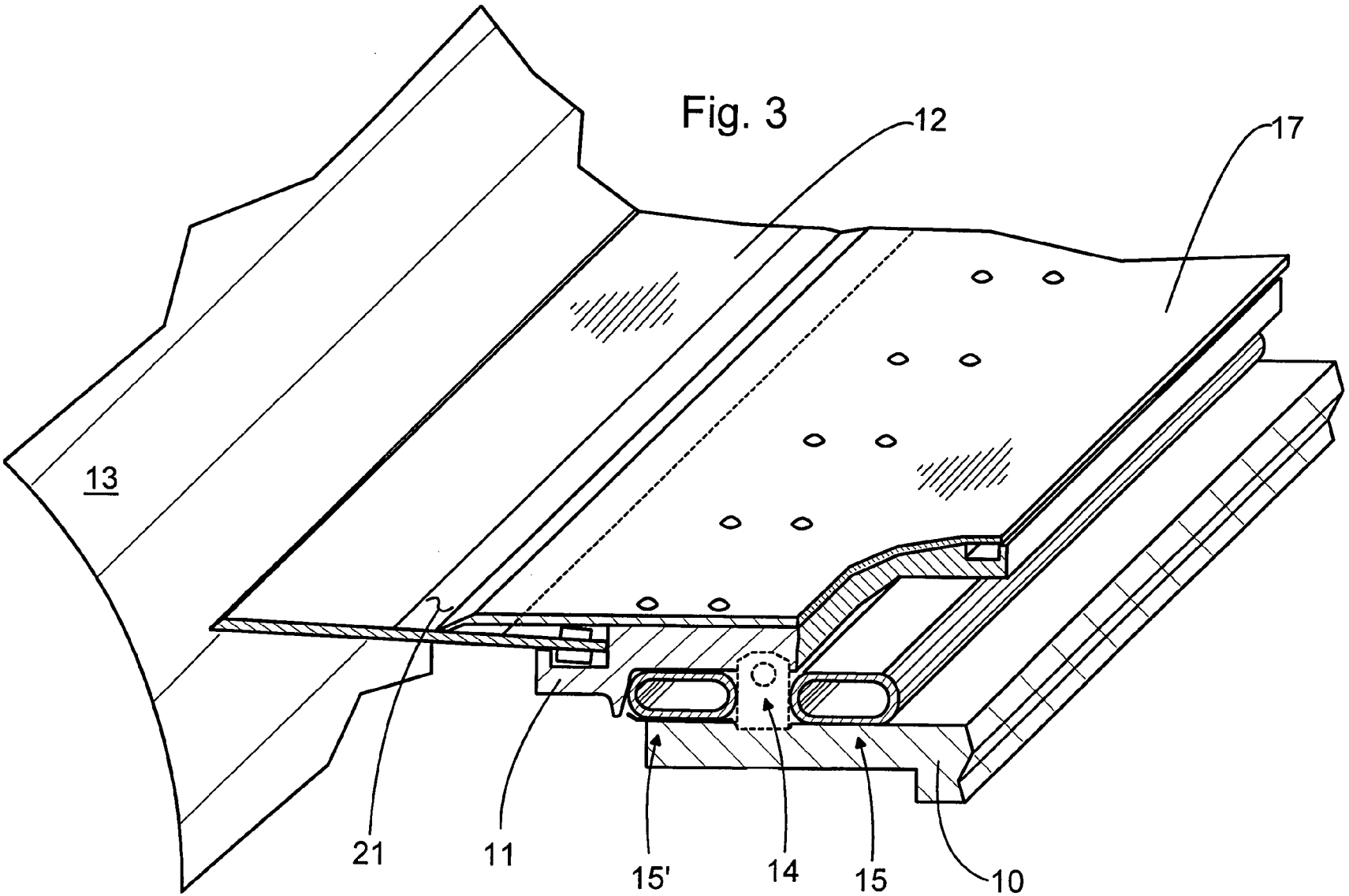
FIG. 3 shows a view similar to that of FIG. 1 of a third embodiment of a doctor unit according to the invention.

The wear of the doctor blade and the doctoring result are also substantially affected by the blade load used, which presses the doctor blade against the surface being doctored. Thus, in terms of the operation and adjustment of the doctor unit it is also important to know the local blade load at different locations on the doctor blade when running. For this purpose, there are one or more sensors on the surface of the blade holder or doctor blade or both, adapted to measure the blade load. In addition, these sensors are extremely sensitive to pressure. In FIG. 3, the sensors 21 are fitted essentially in the area of contact between the top plate 17 of the blade is holder 11 and the doctor blade 12, over the entire width of the doctor unit. This allows the blade load to be determined over the whole width of the doctor unit. The construction of the sensors is shown in greater detail in connection with FIGS. 4*b* and 4*c*.

FIG. 4*a* shows the embodiment of FIG. 1 seen from above. The only part of the doctor unit shown is the doctor blade 12, which as usual has worn mostly in the center. During manufacture, optical fibers 16, shown with broken lines, have been installed in doctor blade 12. According to the invention, the doctor unit includes light-sending devices 20 at one end of the doctor unit and light-receiving devices 20' at the other end. These devices are known and in this case they are in principle attached directly to doctor blade 12. A corresponding construction can also be applied to monitor the condition of the top plate. The figures do not show the rest of the condition-monitoring equipment, as this varies greatly with different applications. However, what is essential is that during operation all the sensors provide explicit information, which can be easily utilized with the aid of existing electronic apparatus.

According to the example, the light led to the optical fibres 16 at one end of the doctor blade 12 is detected at the other end with the aid of, for example, light sensors. However, the two upper optical fibres 16 are broken due to the wear of doctor blade 12, so that they do not conduct light. In addition, because the rest of the optical fibres continue to conduct, the doctor blade is in all likelihood in good condition. The apparatus can use different wavelengths, so that visible light will not affect their operation. On the other hand, when visible light is used, the condition of the doctor blade can be seen even with the naked eye. In addition, different colours can show the limit value of wear. When the limit value is exceeded, the doctor unit is still in operating condition, but plans should be already made for a maintenance shutdown.

FIG. 4*b* shows doctor blade 12 and a pressure-sensitive sensor 21 installed on its surface. According to the invention, the pressure-sensitive sensor is a PVDF membrane sensor that is known. The utilization of such a membrane sensor is also disclosed in Finnish patent 86771. Such a sensor will provide an analog voltage signal proportional to the force and thus also the pressure, which can easily be utilized. The sensors are also easy to calibrate. In addition, the sensors are applicable to a very wide range of forces. The sensors may be separate membrane sensors or assembled to form a single long membrane element, as in FIG. 4*b*. This facilitates the cabling of the sensors. FIGS. 4*b* and 4*c* show only the cabling 22 of a single membrane sensor 21. An EMF sensor operating on the piezoelectric principle, for example, can also be used as a pressure-sensitive sensor.

The membrane sensor may also be in the top plate, though it is easier to install a membrane sensor on the surface of the doctor blade. Particularly when utilizing old doctor units, it is preferable to use an adaptation of the previous embodiment according to FIG. 4*c*. In such a case, the membrane sensors 21 are fitted to a separate plate 23, which is installed in the doctor unit, for example, according to FIG. 5. The plate is fitted in the area of contact between the blade holder and the doctor blade. A plate can easily be installed in an existing doctor unit, allowing the application to be brought quickly into operation. At the same time, the use of a plate does not depend on the material of manufacture of the doctor blade. A membrane sensor can also be installed under one or other or both loading hoses. However, among other things, disturbances caused by the jointing of the blade holder may then occur.

Generally, 1–10, preferably 2–6 PVDF membrane sensors are fitted to each meter of width of the doctor unit. This allows the actual blade load of the doctor blade to be determined in zones. An increase in the number of sensors will naturally give a more precise descriptor of the transverse loading profile, but it will also increase the cabling.

Figure 5:
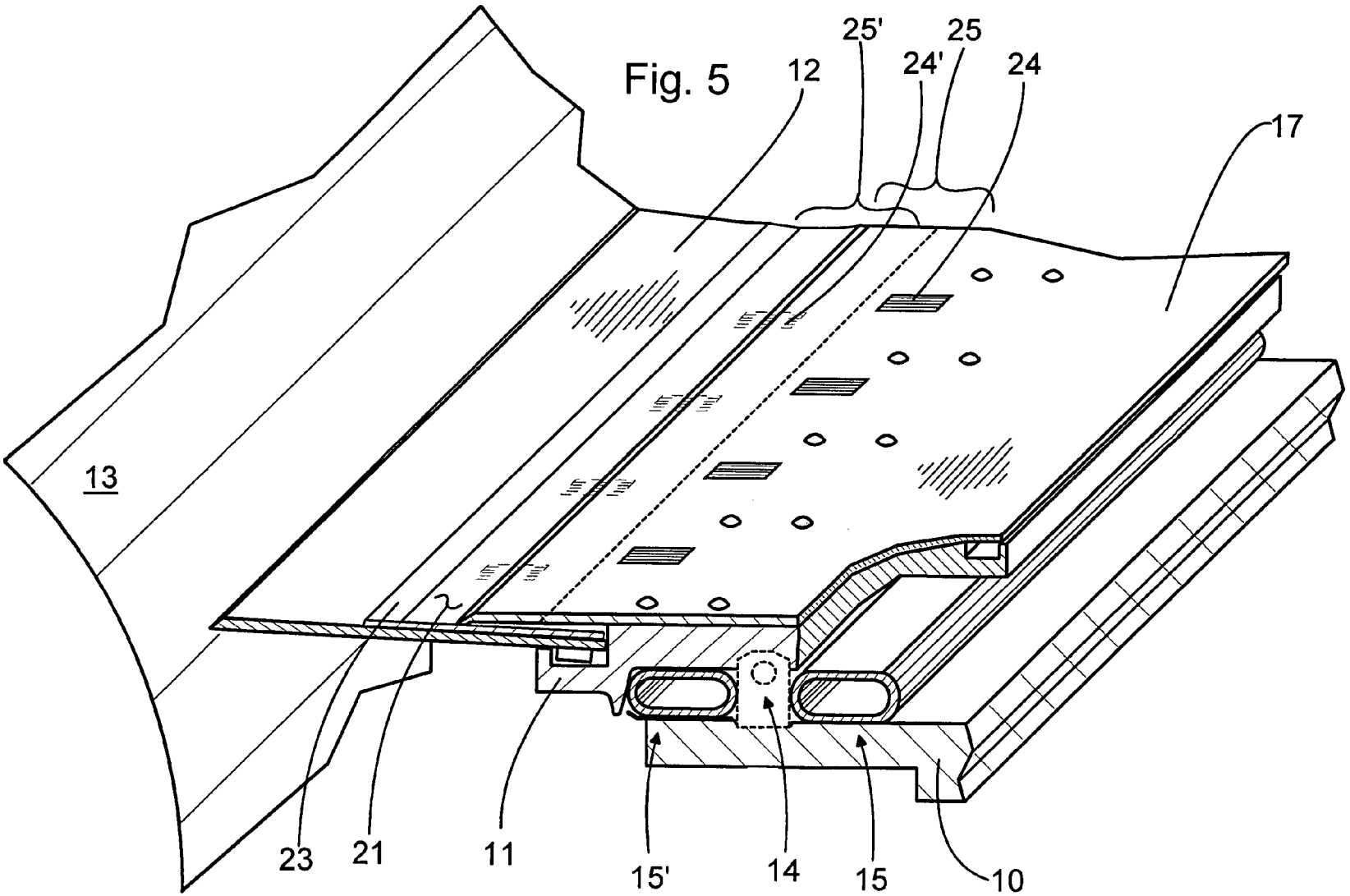
FIG. 5 shows a view similar to that of FIG. 1 of a fourth embodiment of a doctor unit according to the invention.

Instead of membrane sensors, traditional stress-strain sensors 24 and 24' can also be used. Such sensors are preferably situated on the part 25 of the top plate that protrudes free of its frame support or on the doctor blade 12 itself, close to the point of contact 25' with the top plate 17. The sensors can be located on the top or bottom surfaces of the doctor blade. The operating direction of the sensors is naturally set in the machine direction. FIG. 5 shows some alternative locations for sensors. The stress-strain sensors are preferably set as densely as PVDF membrane sensors.

A doctor unit according to the invention can be used to provide comprehensive but explicit information. This is especially important in paper machine operation, in which there are many different doctor units of considerable width. It is nearly impossible to use known methods to monitor such doctor units. The sensors used in the doctor unit do not affect the operation of the doctor unit. On the other hand, the necessary sensors are economical and are well protected. In addition, they can be easily applied to existing doctor units.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A doctor unit in a paper machine includes a blade carrier having a blade holder, and a doctor blade fittable on the blade holder for doctoring a roll or similar moving surface, the doctor unit characterized in that one of the blade holder and doctor blade include at least one sensor installed inside the said one of the blade holder and doctor blade or on a surface of said one of the blade holder and doctor blade, and said sensor is arranged to measure one of the wear and stress in the said one of the blade holder and doctor blade.

2. A doctor unit according to claim 1, characterized in that at least one of the said at least one sensor includes at least one optical fiber installed inside the said one of the blade holder and doctor blade.

3. A doctor unit according to claim 1, characterized in that on the surface of the said one of the blade holder and doctor blade there is included at least one of a pressure-sensitive sensor and stress-strain sensor arranged to measure the blade load.

4. A doctor unit according to claim 2, characterized in that the doctor unit includes light transmitting devices, at one end of the doctor unit, connected to the optical fibers, and light receiving devices at the other end.

5. A doctor unit according to claim 2, characterized in that the blade holder includes a top plate, in which there are one or more optical fibers arranged in essentially the transverse direction of the doctor unit and extending from one end of the top plate to the other.

6. A doctor unit according to claim 2, characterized in that the optical fibers installed inside the doctor blade and extending over the entire length of the doctor blade are arranged essentially transversely to the doctor unit 0.5–10 mm from each other.

7. A doctor unit according to claim 5, characterized in that there are 1–15 optical fibers in one of the said blade holder and the doctor blade.

8. A doctor unit according to claim 3, characterized in that sensors are arranged essentially over the entire width of the doctor unit in the area of contact between the top plate belonging to the blade holder and the doctor blade.

9. A doctor unit according to claim 3, characterized in that the pressure-sensitive sensor is one of a PVDF membrane sensor and an EMF sensor operating on the piezoelectric principle.

10. A doctor unit according to claim 9, characterized in that 1–10 PVDF sensors are fitted over the width of the doctor unit to each meter of the width of the doctor unit.

11. A doctor unit according to claim 2, characterized in that the optical fiber includes filaments and that the optical fiber is operatively connected to an electrical crystal, which is arranged to send a signal when the resistance in the optical fiber changes due to the wear of the filaments.

12. A doctor unit according to claim 1, characterized in that the sensor is operatively connected to the selected monitoring system and arranged such that the duration of sensor measurement is settable in a range between momentary and continuous measurement.

* * * * *